US012553194B2

(12) United States Patent
Mason

(10) Patent No.: US 12,553,194 B2
(45) Date of Patent: Feb. 17, 2026

(54) APPARATUS FOR FORMING A PATHWAY JOINT

(71) Applicant: Illinois Tool Works Inc., Glenview, IL (US)

(72) Inventor: Greg Stephen Mason, Brisbane (AU)

(73) Assignee: Illinois Tool Works Inc., Glenview, IL (US)

( * ) Notice: Subject to any disclaimer, the term of this patent is extended or adjusted under 35 U.S.C. 154(b) by 250 days.

(21) Appl. No.: 18/463,426

(22) Filed: Sep. 8, 2023

(65) Prior Publication Data

US 2025/0067007 A1 Feb. 27, 2025

(30) Foreign Application Priority Data

Aug. 24, 2023 (AU) ..... 2023219910

(51) Int. Cl.

*E01C 5/06* (2006.01)
*E01C 15/00* (2006.01)
*E04B 1/68* (2006.01)

(52) U.S. Cl.

CPC ..... *E01C 15/00* (2013.01); *E04B 1/6807* (2013.01); *E01C 5/06* (2013.01)

(58) Field of Classification Search

CPC ..... E04B 1/681; E04B 1/6807; E01C 5/06; E01C 15/00
USPC ..... 52/396.02, 396.1, 573.1, 596, 578
See application file for complete search history.

(56) References Cited

U.S. PATENT DOCUMENTS 1,298,018 A 3/1919 Davis
1,894,395 A 1/1933 Burrell
2,064,528 A 12/1936 Fischer
2,319,972 A 5/1943 Brickman
3,297,800 A 1/1967 Bradley
3,601,943 A * 8/1971 Danois ..... E04B 1/681 52/396.05
3,884,000 A 5/1975 Faleij
3,994,609 A * 11/1976 Puccio ..... E01C 11/126 404/69
4,447,172 A 5/1984 Galbreath
4,823,531 A * 4/1989 Labelle ..... E06B 9/15 160/235
4,901,495 A * 2/1990 Gottschling ..... E04B 1/6804 52/396.05
5,261,635 A 11/1993 Flathau
6,460,214 B1 * 10/2002 Chang ..... E01D 19/06 14/73.1
7,354,219 B2 * 4/2008 Leonberg ..... E01D 19/06 404/58
8,627,626 B2 * 1/2014 Boxall ..... E04B 1/483 52/396.02

(Continued)

FOREIGN PATENT DOCUMENTS

GB 2500626 A 10/2013

*Primary Examiner* — Paola Agudelo
(74) *Attorney, Agent, or Firm* — Neal, Gerber & Eisenberg LLP

(57) ABSTRACT

An apparatus for forming a joint between concrete panels to be cast, the apparatus including an element forming a barrier having an upper section providing an upper round surface for relative rotation of the panels in a first direction and a lower section providing a lower round surface for relative rotation of the panels in a second direction opposite to the first direction.

24 Claims, 14 Drawing Sheets

(56) References Cited

U.S. PATENT DOCUMENTS

| | | | | |
|---|---|---|---|---|
| 8,869,482 | B2 * | 10/2014 | Hunke | E04B 5/00 52/395 |
| 9,435,114 | B1 | 9/2016 | Preston | |
| 10,077,533 | B2 | 9/2018 | Meuwissen et al. | |
| 10,094,075 | B2 | 10/2018 | Keen | |
| 10,323,359 | B2 | 6/2019 | Meuwissen et al. | |
| 10,711,410 | B2 | 7/2020 | Meuwissen et al. | |
| D1,021,150 | S | 4/2024 | Griffith et al. | |
| D1,026,252 | S | 5/2024 | Kersting | |
| 2002/0059764 | A1 * | 5/2002 | Schluter | E04F 15/02027 52/468 |
| 2014/0241787 | A1 * | 8/2014 | Campbell | C08G 18/42 156/331.7 |
| 2018/0366472 | A1 | 12/2018 | Wu et al. | |
| 2018/0371703 | A1 | 12/2018 | Meuwissen et al. | |
| 2020/0362523 | A1 * | 11/2020 | Rill | E01C 11/02 |
| 2020/0370685 | A1 | 11/2020 | SchlÜsselbauer | |
| 2023/0061416 | A1 | 3/2023 | Mason | |
| 2023/0323609 | A1 | 10/2023 | Wiatrowski | |

* cited by examiner

APPARATUS FOR FORMING A PATHWAY JOINT

PRIORITY

This application claims priority to and the benefit of Australian Patent Application No. 2023219910, filed Aug. 24, 2023, the entire contents of which are incorporated herein by reference.

CROSS-REFERENCE TO RELATED APPLICATIONS

This application is related to the following commonly owned co-pending patent application: U.S. application Ser. No. 29/911,764, entitled "JOINT FORMER".

FIELD

The present disclosure relates to technologies for a joint in a settable material, for example, for when there is expected movement in the joint due to tree roots, reactive soil, or otherwise. More specifically, but not exclusively, the present disclosure relates to an apparatus for forming a control joint in a pedestrian pavement or pathway that enables load transfer between pathway panels and articulation between panels.

BACKGROUND

It is known to provide a keyed joint in concrete. More specifically, as it is recognized that concrete undergoes thermal expansion and contraction, it has been proposed to provide expansion joints for breaks in concrete slabs, footpaths, and the like to minimize unwanted cracking in the concrete. However, although existing keyed joints in concrete may enable transfer of load between one concrete member and a neighbouring concrete member, such installations may still be prone to unwanted cracking and/or creation of uneven concrete members where there is soil movement and/or movement due to a tree root. Existing concrete joint systems can be prohibitively expensive for use in some situations, particularly situations where many joints are required such as in a footpath/sidewalk.

It would be advantageous for there to be provided a joint system between concrete components that obviates or at least ameliorates one or more disadvantages of existing concrete joint systems.

SUMMARY

In accordance with one aspect of the present disclosure, there is provided an apparatus for forming a joint between concrete panels to be cast, the apparatus including an element forming a barrier having an upper section providing an upper round surface for relative rotation of the panels in a first direction and a lower section providing a lower round surface for relative rotation of the panels in a second direction opposite to the first direction.

Preferably, said upper section forms a rounding in a first concrete panel and a corresponding rounding in a second concrete panel for relative rotation of the panels in said first direction. More preferably, said lower section forms a rounding in the first concrete panel and a corresponding rounding in the second concrete panel for relative rotation of the panels in said second direction.

In a preferred form, the element includes a transverse section for forming an upper transverse surface in one of the panels and a corresponding lower transverse surface in another of the panels for transferring vertical force across the joint. More preferably, the upper section forms an upper rounding in the first concrete panel and a corresponding lower rounding in the second concrete panel, the lower section forms an upper rounding in the first concrete panel and a corresponding lower rounding in the second concrete panel. Even more preferably, the upper section forms an upper convex rounding in the first concrete panel and a corresponding lower concave rounding in the second concrete panel, the lower section forming an upper concave rounding in the first concrete panel and a corresponding lower convex rounding in the second concrete panel.

Preferably, the transverse section is planar. More preferably, the transverse section is horizontal.

In a preferred form, the transverse section is intermediate the upper section and the lower section.

Preferably, the element includes an upper formation for coupling to a stake bracket, and a lower formation for coupling to the stake bracket. More preferably, the upper formation is located above the transverse section and the lower formation is located below the transverse section.

In one form, the element is in the form of a unitary extrusion.

In accordance with another aspect of the present disclosure, there is provided a jointing element for formation of a joint in cast concrete, wherein the jointing element forms the joint to serve as an expansion joint enabling vertical load transfer across the joint, and wherein the jointing element forms the joint to act as a hinge enabling articulation across the joint.

Preferably, the jointing element forms a joint between a first concrete component and a second concrete component, forming an upper hinge for rotation of the first concrete component in one direction relative to the second concrete component, and a lower hinge for rotation of the first concrete component in an opposite direction relative to the second concrete component.

In a preferred form, the jointing element includes an upper section for forming the upper hinge and a lower section for forming the lower hinge. More preferably, the jointing element includes a transverse section intermediate the upper section and the lower section. Even more preferably, the transverse section is planar. In one form, the transverse section is horizontal.

Preferably, the jointing element is in the form of a unitary extrusion. More preferably, the jointing element includes a removable capping at an upper portion of the jointing element. Even more preferably, the removable capping is co-extruded.

In one form, the jointing element is formed from a corrosion-free plastic material.

Preferably, the apparatus is for forming a pathway joint between concrete panels to be cast.

BRIEF DESCRIPTION OF THE DRAWINGS

Preferred example embodiments of the disclosure will be described, by way of a non-limiting example only, with reference to the accompanying drawings.

DETAILED DESCRIPTION

Figure 1:
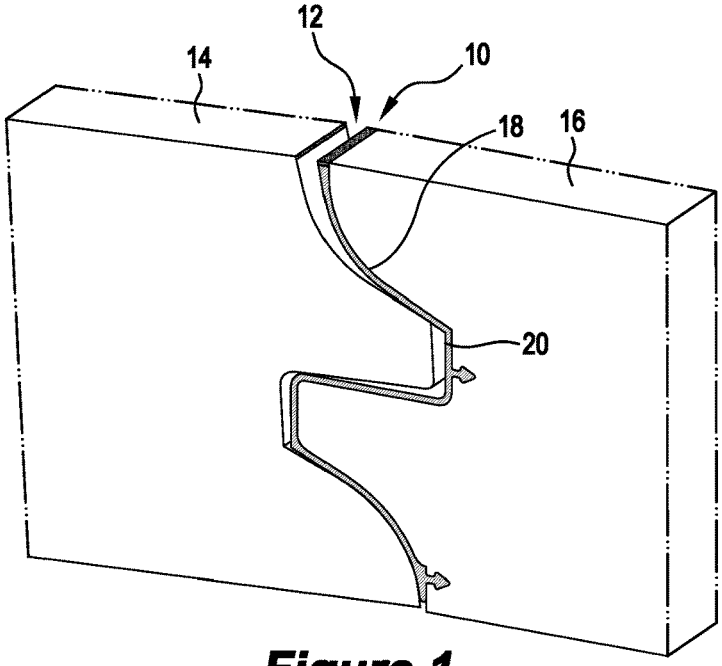
FIG. 1 is a top perspective view of an articulating geared control joint in accordance with an example embodiment of the present disclosure.

While the systems, devices, and methods described herein can be embodied in various forms, the drawings show, and the specification describes certain exemplary and non-limiting embodiments. Not all components shown in the drawings and described in the specification can be required, and certain implementations can include additional, different, or fewer components. Variations in the arrangement and type of the components; the shapes, sizes, and materials of the components; and the manners of connections of the components can be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

With reference to FIGS. 1 to 29 of the drawings, there are shown four aspects of a new system suitable for providing joints in pavements, particularly where there is expected movement in the pavement by way of ground movement underneath, for example by growing tree roots and/or soil movement. The system provides a relatively simple and cost-effective solution that enables hinged movement between pavement panels while also preventing uneven concrete panels. The four aspects are described in further detail below, with reference to the drawings.

Articulating Geared Control Joint

Figure 2:
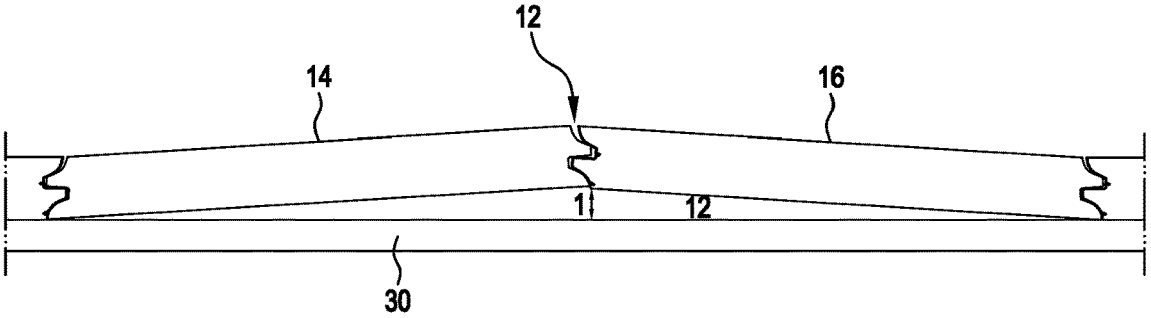
FIG. 2 is a side view of the geared control joint of FIG. 1, showing the joint deflected upwardly.

With reference to FIGS. 1 to 9, there is provided an apparatus 10 for forming a joint 12 between concrete panels 14 and 16 to be cast. The apparatus 10 includes an element 18 forming a barrier 20 having an upper section 22 providing an upper round surface 24 for relative rotation of the panels 14 and 16 in a first direction and a lower section 26 providing a lower round surface 28 for relative rotation of the panels 14 and 16 in a second direction opposite to the first direction. As can be seen in FIG. 2, the apparatus 10 is able to accommodate upward pivoting of the joint 12 such that the panels 14 and 16 rise to at least a gradient of 1:12 with reference to an underlying ground surface 30.

Figure 3:
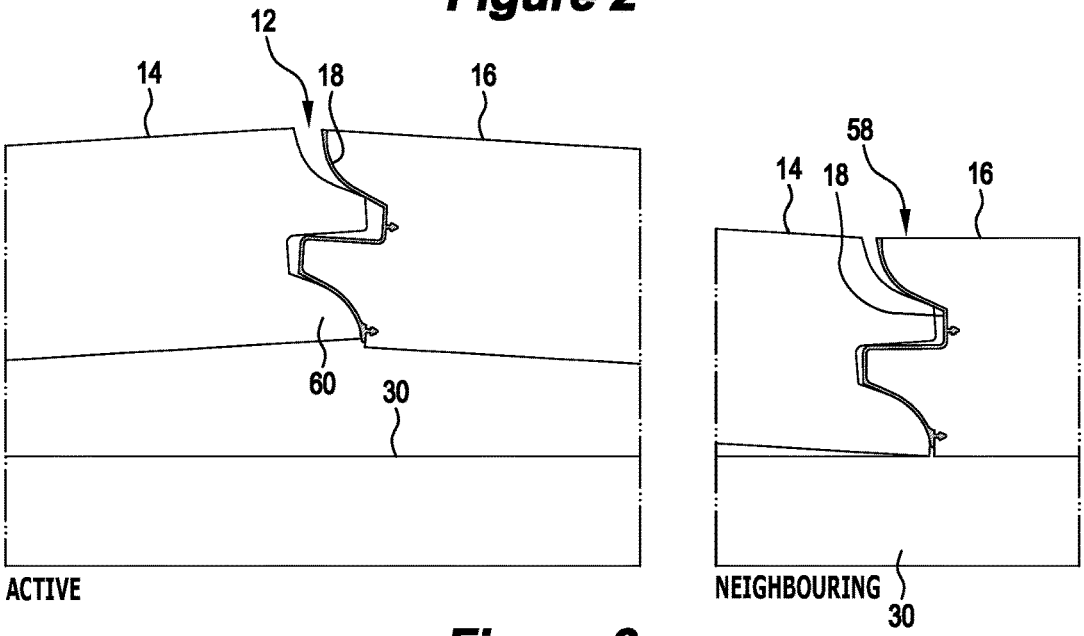
FIG. 3 is a detailed side view of the joint shown in FIG. 2, and a further detailed side view showing deflection in an opposite direction.

In particular, the apparatus 10 facilitates simultaneous movement of neighbouring slabs (panels 14 and 16) that enable deflection control on light duty concrete pavements when the joint 12 articulates due to tree roots or reactive soil. The apparatus 10 enables up to 1:12 simultaneous vertical lift on the slabs while maintaining deflection control, load transfer, lateral movement, and contraction capabilities. There is provided multiple contact point rotation of the neighbouring slabs to maximize load transfer and to minimize deflection. With reference to FIG. 3, the apparatus 10 facilitates movement in both directions, which is the joint 12 forming an upper elbow as shown on the left-hand side of FIG. 3 or the joint 12 forming a lower elbow as shown on the right-hand side of FIG. 3.

Figure 4:
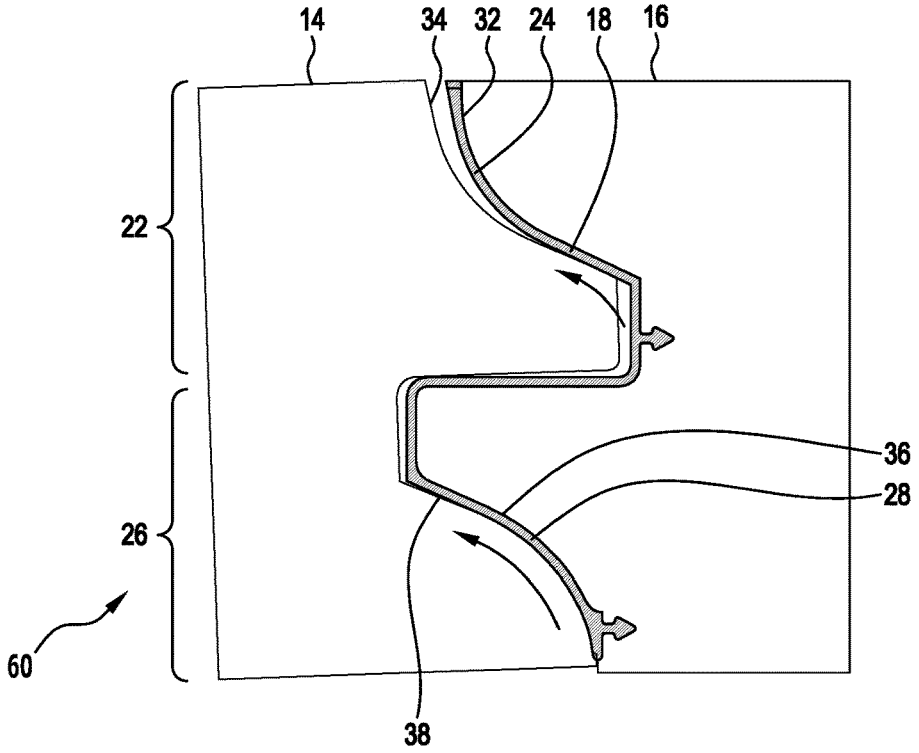
FIG. 4 is a detailed side view of the joint of FIG. 1 showing deflection about a lower pivot.
Figure 5:
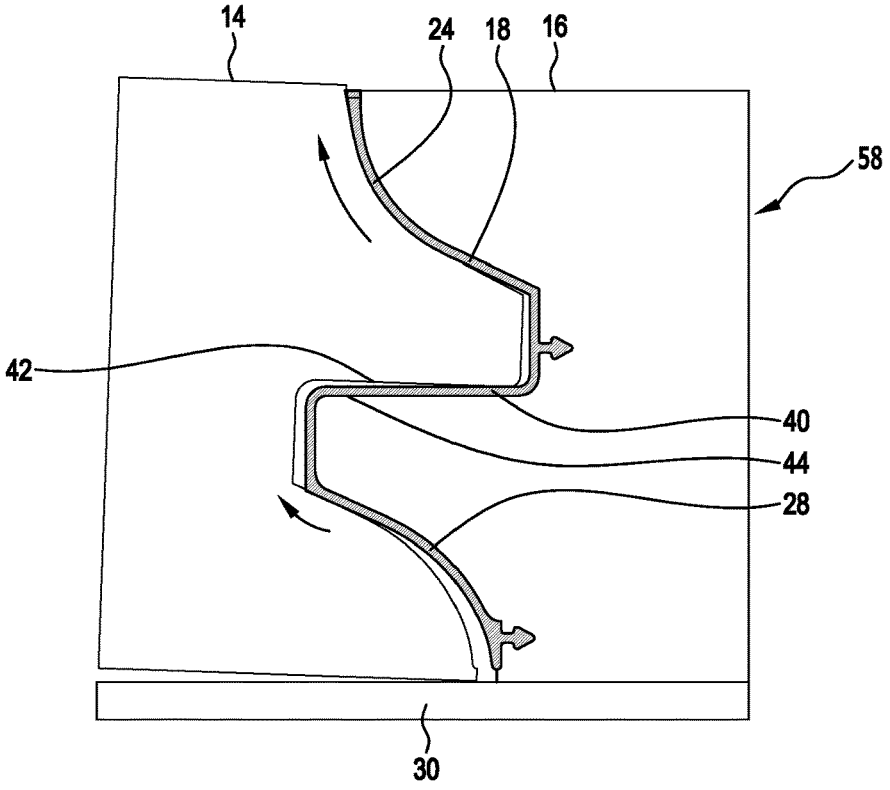
FIG. 5 is a detailed side view of the joint of FIG. 1 showing deflection about an upper pivot.

As shown in the cross-sectional views of FIG. 4 and FIG. 5, the upper section 22 forms a rounding 32 in a first concrete panel 16 and a corresponding rounding 34 in a second concrete panel 14 for relative rotation of the panels 14 and 16 in said first direction (see right-hand side of FIG. 3). Also, the lower section 26 forms an upper concave rounding 36 in the first concrete panel 16 and a corresponding lower convex rounding 38 in the second concrete panel 14 for relative rotation of the panels in said second direction (see left-hand side of FIG. 3).

The element 18 includes a transverse section 40 for forming an upper transverse surface 42 in one of the panels and a corresponding lower transverse surface 44 in another of the panels for transferring vertical force across the joint 12. The upper section 22 forms the upper convex rounding 32 in the first concrete panel 16 and the corresponding lower concave rounding 34 in the second concrete panel 14. The lower section 26 forms the upper concave rounding 36 in the first concrete panel 16 and the corresponding lower convex rounding 38 in the second concrete panel 14.

In the example shown, the transverse section 40 is planar and horizontal, being parallel to the pathway surface formed by the upper surfaces of the concrete panels 14 and 16. The transverse section 40 is intermediate the upper section 22 and the lower section 26.

Figure 6:
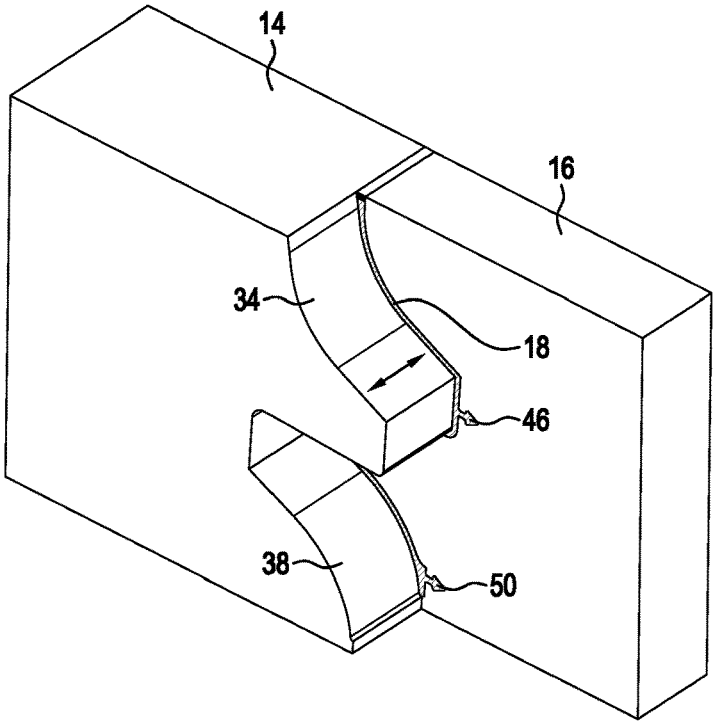
FIG. 6 is an upper perspective view showing lateral sliding across the joint of FIG. 1.

As shown in FIG. 6, the element 18 includes an upper formation 46 for coupling to a stake bracket 48, and a lower formation 50 for coupling to the stake bracket 48. The upper formation 46 is located above the transverse section 40 and the lower formation 50 is located below the transverse section 40.

As depicted in FIG. 6, it is also advantageous that the profile of the apparatus 10 does not restrain the movement of the panels 14 and 16 laterally such that the panels 14 and 16 are able to mutually slide.

Figure 7:
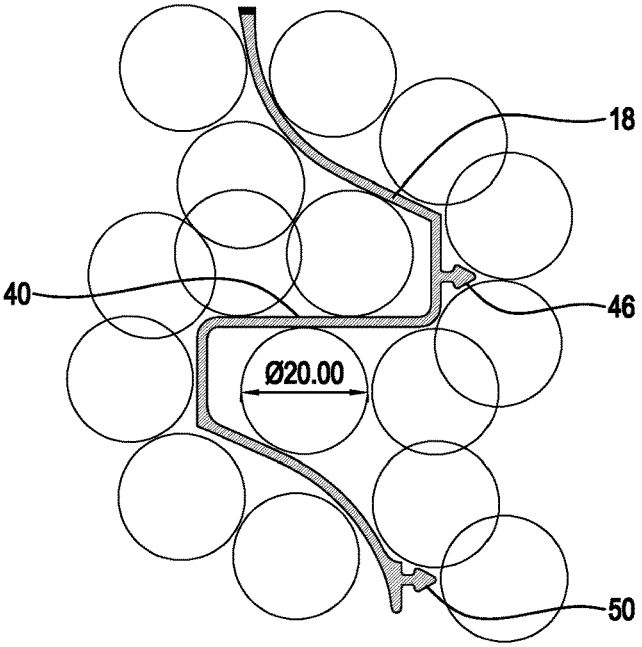
FIG. 7 is a side view of an element for formation of the joint of FIG. 1 in cast concrete, depicting ability to enable a beneficial flow rate of aggregate around the element.

With reference to FIG. 7, the element 18 is in the form of a unitary extrusion with a constant cross-section along its length. The profile of the element 18 facilitates concrete and 20 mm aggregate flow and compaction around the joint 12 from both sides. The extrusion can be in the form of a corrosion free uPVC joint profile.

Figure 8:
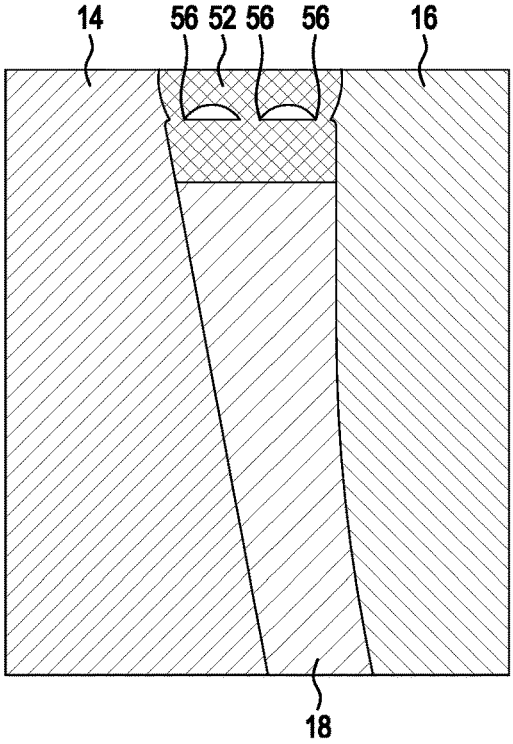
FIG. 8 is a detailed side view of the element showing an upper strip attached to the joint of FIG. 1.
Figure 9:
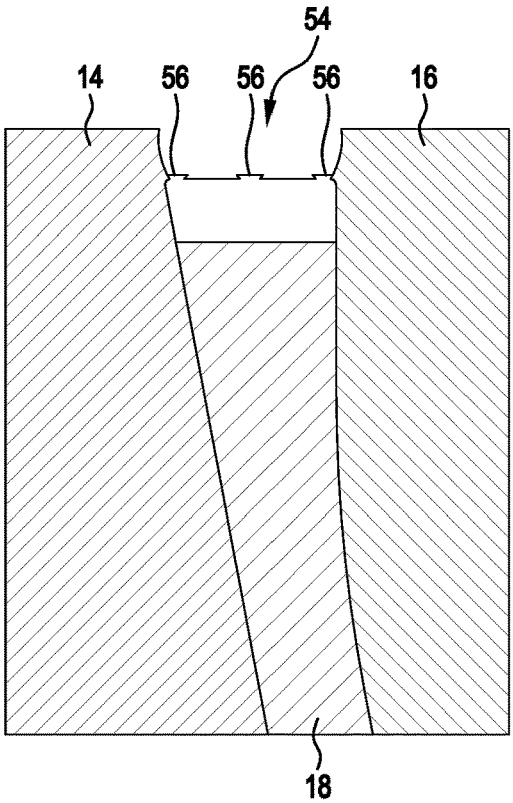
FIG. 9 is a detailed side view of the element shown after detaching the upper strip from the joint of FIG. 1.

Turning to FIG. 8 and FIG. 9, the element 18 can be provided with a co-extruded PVC capping 52 (for example, in black or grey) with a built in rip-a-strip function such that the capping 52 is able to be frangibly removed to provide an attractive and/or functional upper recess 54 between the panels 14 and 16. The capping 52 can be connected by spaced frangible connecting strips 56 along the length of the capping 52 such that the capping 52 is able to be torn away from the remainder of the element 18. The capping 52 can be removed after pouring to remove concrete latency from on top of the joint 12, giving a clean visible joint line.

Accordingly, there is provided a jointing element 18 for formation of a joint 12 in cast concrete, wherein the jointing element 18 forms the joint 12 to serve as an expansion joint enabling vertical load transfer across the joint 12. The jointing element 18 forms the joint 12 to act as a hinge, enabling articulation across the joint 12.

Those skilled in the art will appreciate that the jointing element 18 forms a joint 12 between the first concrete component 16 and the second concrete component 14, forming an upper hinge 58 (formed by cooperation of the upper convex rounding 32 and the lower concave rounding 34) for rotation of the first concrete component 16 in one direction relative to the second concrete component 14, and a lower hinge 60 (formed by cooperation of the upper concave rounding 36 and the lower convex rounding 38) for rotation of the first concrete component 16 in an opposite direction relative to the second concrete component 14. Operation of the upper hinge 58 is shown in FIG. 5 and operation of the lower hinge 60 is shown in FIG. 4.

As will be understood from the above, the jointing element 18 includes the upper section 22 for forming the upper hinge 58 and the lower section 26 for forming the lower hinge 60. The jointing element 18 includes the transverse section 40 intermediate the upper section 22 and the lower section 26. In the example shown in the drawings, the transverse section 40 is planar and horizontal.

In the example shown, the jointing element 18 is in the form of a unitary extrusion and the jointing element 18 includes the removable capping 52 at an upper portion of the jointing element 18. The removable capping 52 can be co-extruded. The jointing element 18 can be formed from a corrosion-free plastic material. The apparatus 10 can be for forming a pathway joint between concrete panels to be cast.

As will be appreciated from the above, this aspect provides a corrosion free keyed control joint which can give advantages such as the following: (1) facilitates simultaneous movement of neighbouring slabs that enables deflection control on light duty; (2) enables safe concrete pavements when joint articulates due to tree roots or reactive soil; (3) allows up to 1:12 simultaneous vertical lift on slabs while maintaining deflection control, load transfer, lateral movement, and contraction capabilities; (4) multiple contact point rotation of neighbouring slabs to maximize load transfer and minimize deflection; (5) facilitates movement in both directions; (6) profile does not restrain the movement of neighbouring slabs laterally; (7) joint profile facilitates concrete and 20 mm aggregate flow and compaction around joint (both sides); (8) extruded corrosion free uPVC joint profile; (9) co-extruded PVC capping (black or grey) with built-in rip-a-strip function (strip can be removed after); and (10) pouring to remove concrete latency from on top of the joint giving a clean visible joint line.

Dual Overlapping Shear Keys

With reference to FIGS. 10 to 14 of the drawings, another aspect provides an apparatus 10 for forming a pathway joint 12 between concrete panels 14 and 16 to be cast, the apparatus 10 including an element 18 forming a barrier 20. The barrier 20 is arranged to form a plurality of overlapping shear keys 62, 64, 66, and 68 in the concrete panels 14 and 16 to facilitate vertical load transfer across the pathway joint 12.

The barrier 20 is arranged to form a first pair of shear keys 62 and 64 in a first of the concrete panels 16, and a second pair of shear keys 66 and 68 in a second of the concrete panels 14, such that the first pair of shear keys 62 and 64 are interleaved with the second pair of shear keys 66 and 68 to facilitate vertical load transfer across the pathway joint 12. More specifically, the first concrete panel 16 has an upper shear key 62 and a lower shear key 64, the second concrete panel 14 has an upper shear key 66 and a lower shear key 68, the lower shear key 64 of the first concrete panel 16 having a planar surface 70 which acts, via the element 18, against a planar surface 72 of the upper shear key 66 of the second concrete panel 14 to facilitate vertical load transfer across the pathway joint 12.

The planar surface 70 of the lower shear key 64 of the first concrete panel 16 and the planar surface 72 of the upper shear key 66 of the second concrete panel 14 are parallel to the pathway—formed by upper surfaces of the panels 14 and 16—to facilitate sliding of the first concrete panel 16 relative to the second concrete panel 14 and thereby longitudinal expansion across the pathway joint 12. The lower shear key 64 of the first concrete panel 16 has a concave surface (upper concave rounding 36) which acts, via the element 18, against a convex surface (lower convex rounding 38) of the lower shear key 68 of the second concrete panel 14 to facilitate rotation across the joint 12 in one direction about the lower hinge 60. The upper shear key 66 of the second concrete panel 14 has a concave surface (lower concave rounding 34) which acts, via the element 18, against a convex surface (upper convex rounding 32) of the upper shear key 62 of the first concrete panel 16 to facilitate rotation across the joint 12 in an opposite direction about the upper hinge 58.

The element 18 includes at least one formation 46 and/or 50 for retaining the element 18 to one of the concrete panels 16 during shrinkage of the concrete. More specifically, the element 18 includes the upper formation 46 and the lower formation 50 for retaining the element 18 to one of the concrete panels 16 during shrinkage of the concrete. The formations 46 and 50 are barbed formations for embedding in the first concrete panel 16, between the upper shear key 62 and the lower shear key 64 of the first concrete panel 16, and a lower barbed formation 50 for embedding in the first concrete panel 16, below the lower shear key 64 of the first concrete panel 16.

As will be appreciated from the above, examples of the present disclosure provide a jointing element 18 for formation of a joint 12 in cast concrete, wherein the jointing element 18 forms the cast concrete to have a plurality of overlapping shear keys 62, 64, 66, and 68 across the joint 12 to serve as an expansion joint for transferring vertical load across the joint 12.

Figure 10:
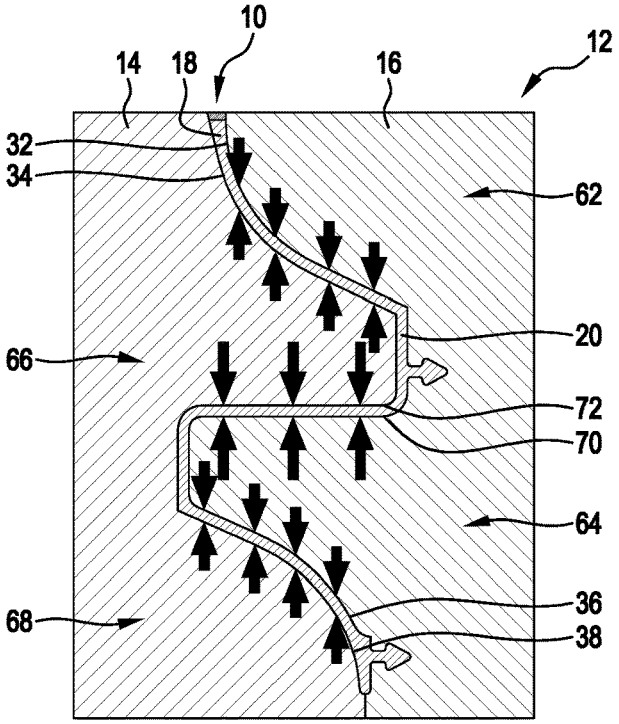
FIG. 10 is a side view of the element embedded in concrete, depicting dual overlapping shear keys in accordance with an example embodiment of the present disclosure.
Figure 11:
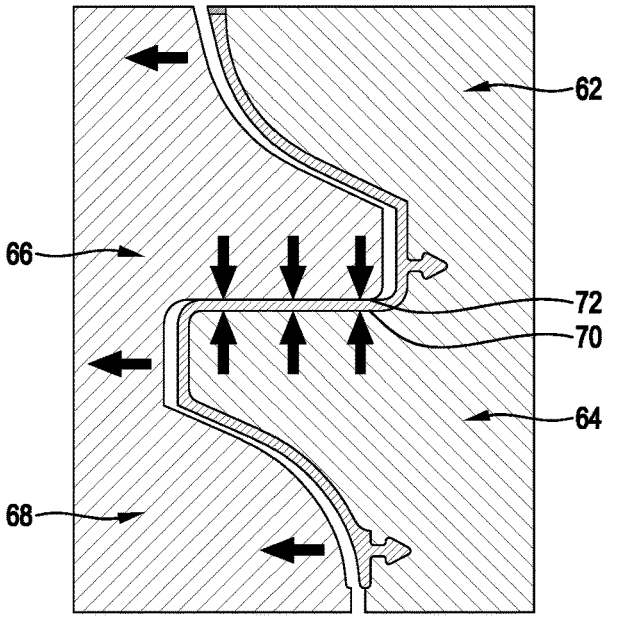
FIG. 11 is a side view showing operation of locking barbs of the element of the joint of FIG. 1.

The vertical arrows in FIGS. 10 and 11 depict vertical loads across the joint, and the horizontal arrows in FIG. 11 depict relative sliding movement of the panels 14 and 16.

Figure 12:
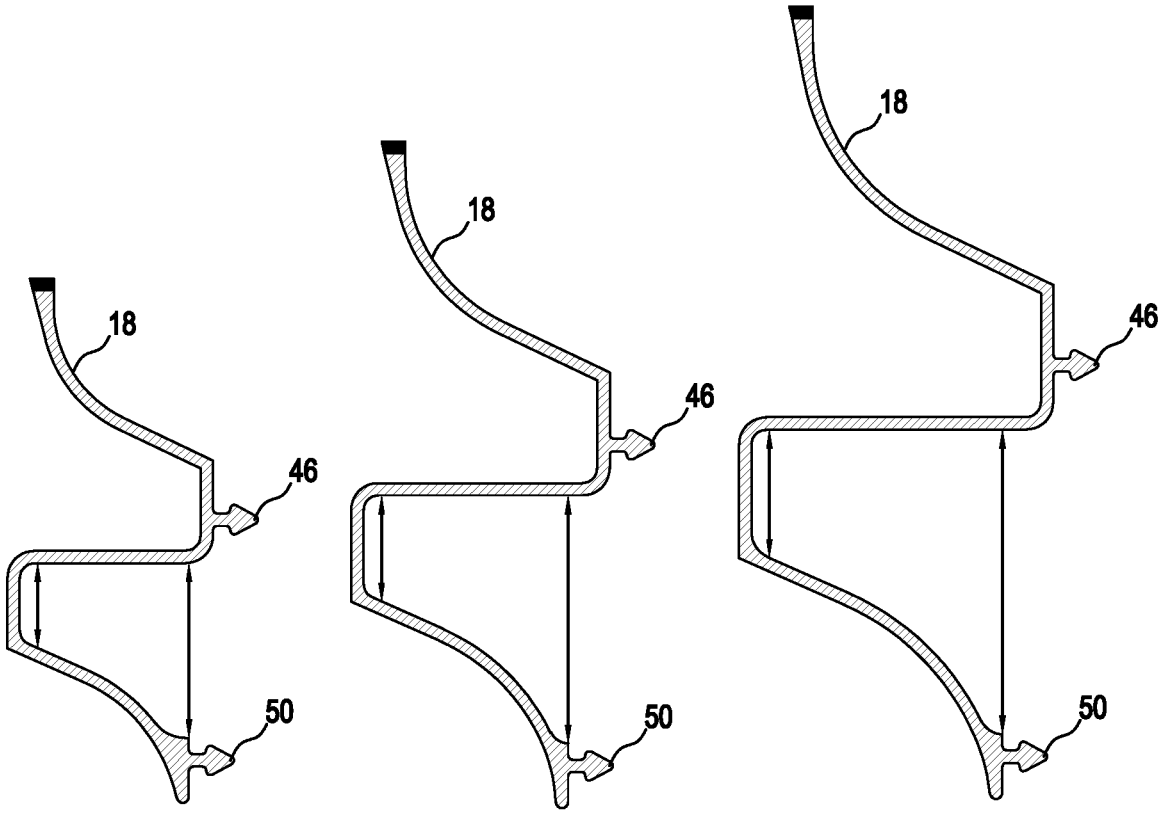
FIG. 12 is a side view showing profiles of three different sizes of element of the joint of FIG. 1.
Figure 13:
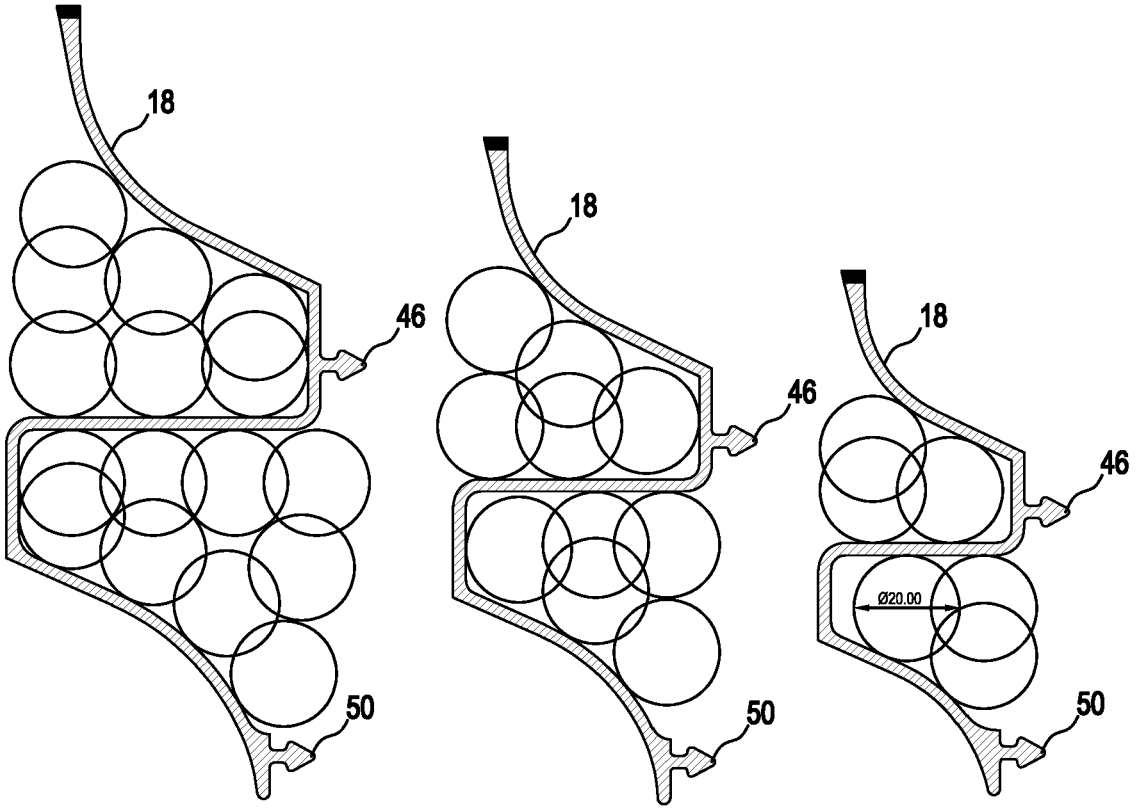
FIG. 13 is a side view of the profiles depicting ability to enable a beneficial flow rate of aggregate for all three sizes of the joint of FIG. 1.
Figure 14:
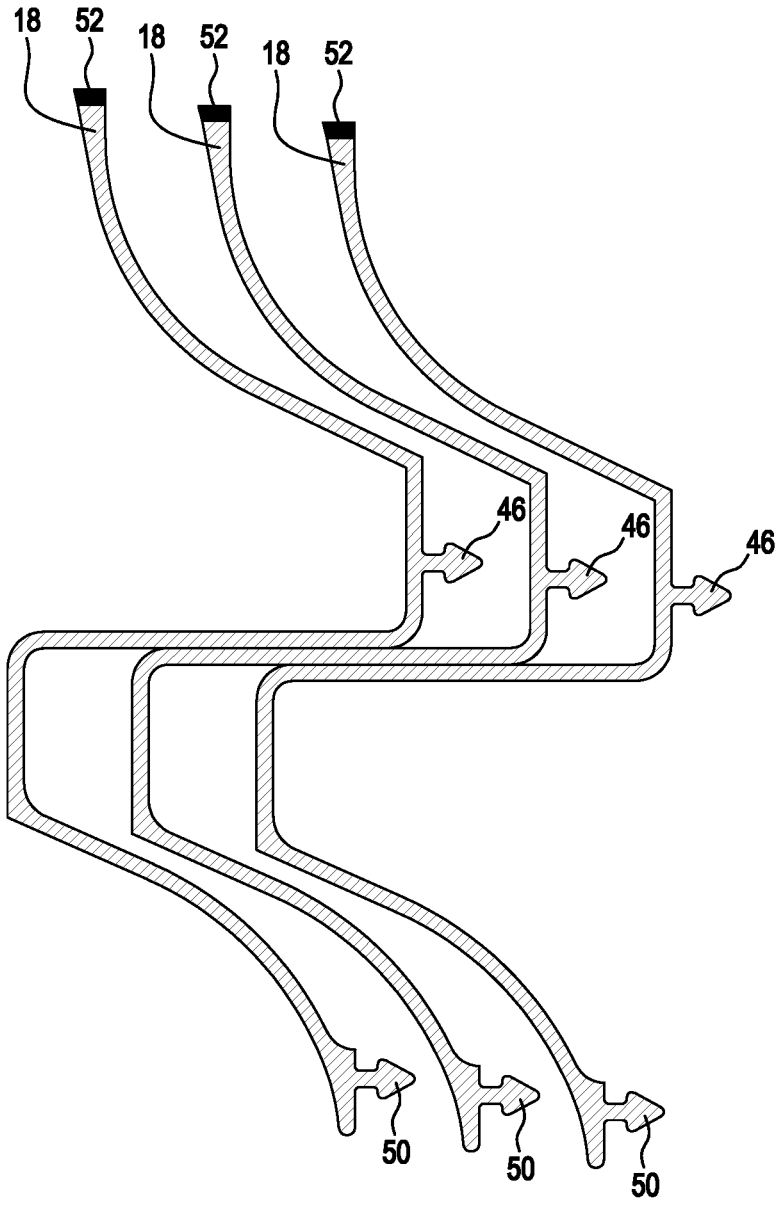
FIG. 14 is a side view showing nesting of the elements of the joint of FIG. 1.

The jointing element 18 forms the cast concrete to act as a hinge 58 and 60 enabling articulation across the joint 12. The jointing element 18 can be formed as a unitary extrusion. With reference to FIG. 12 and FIG. 13, the jointing element 18 can be formed in a variety of sizes (for example, 100 mm, 125 mm, and 150 mm versions) for different pathway applications. The jointing element 18 can be shaped to facilitate nesting of like jointing elements prior to installation, as shown in FIG. 14. This nesting ability can facilitate compact packaging of multiple lengths of jointing element 18 in a nested arrangement.

By virtue of the transverse section 40, the jointing element 18 can provide a flat load-bearing surface between dual alternating shear keys.

The jointing element 18 can be formed from a corrosion free plastic material.

As will be appreciated from the above, this aspect controls deflection by way of overlapping shear keys, providing a corrosion free keyed control joint. The following advantages can be provided: (1) continuous load transfer (both directions) across the full width of the joint profile; (2) three point loading on shear keys before shrinkage; (3) interlocking dual shear keys slide upon each other horizontally to control joint deflection during joint contraction (up to 10 mm) once angular section disengages due to concrete shrinkage; (4) deep shear key voids without restraint in movement from opposing joint side or setup methods; (5) the shear keys' size and depth scale as the joint height increases to provide more efficient loading capabilities on larger joint sizes; (6) radiused edges and curves to minimise re-entrant cracking; (7) large lead in points to both shear keys to facilitate concrete and aggregate flow (see FIG. 13); (8) the change in joint angles at the shear keys stiffens the joint profile along the length, increasing rigidity during transportation, installation and pouring; and (9) the shape of the dual keys facilitates joint nesting for packaging (see FIG. 14).

Standardized Dual Joiner Connection

Turning to FIGS. 15 to 20, another aspect provides an apparatus 10 for forming a pathway joint between concrete panels 14 and 16 to be cast, the apparatus 10 including a jointing element 18 for forming a barrier 20 between the concrete panels 14 and 16, the jointing element 18 having a first length 74 and a second length 76. The apparatus 10 further includes a first connector 78 and a second connector 80, wherein the first connector 78 is arranged for coupling an upper portion 82 of the first length 74 to an upper portion 82 of the second length 76, and wherein the second connector 80 is arranged for coupling a lower portion 84 of the first length 74 to a lower portion 84 of the second length 76. The connectors 78, 80 can be used for situations where the standard length of the jointing element 18 is insufficient for the width of a pathway/footpath. For example, the jointing element 18 can be provided in 3 m lengths and the connectors 78 and 80 can be used where lengths longer than 3 m are required.

Figure 18:
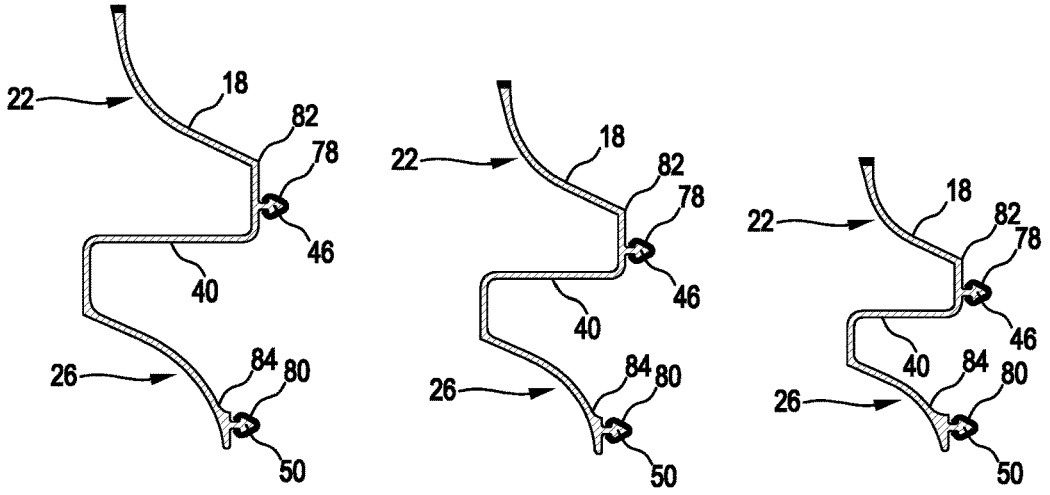
FIG. 18 is a side view of the elements of the joint of FIG. 1 coupled by connectors shown in FIG. 17.
Figure 19:
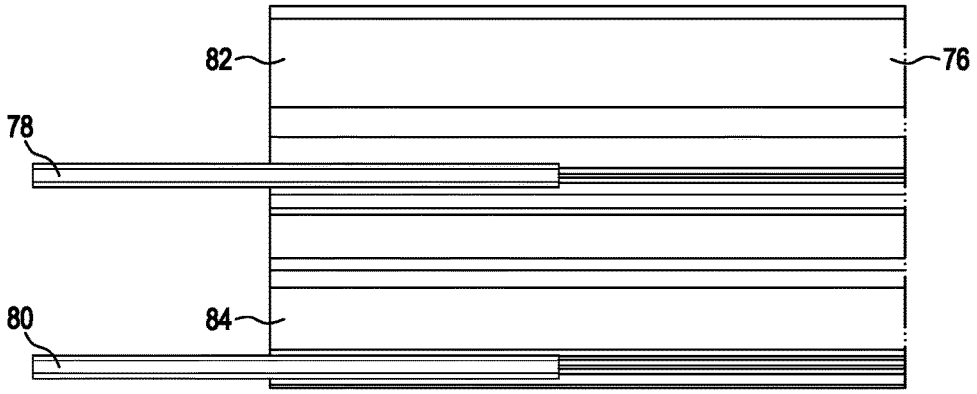
FIG. 19 is a front view of a pair of connectors shown coupled to a single length of a jointing element.
Figure 20:
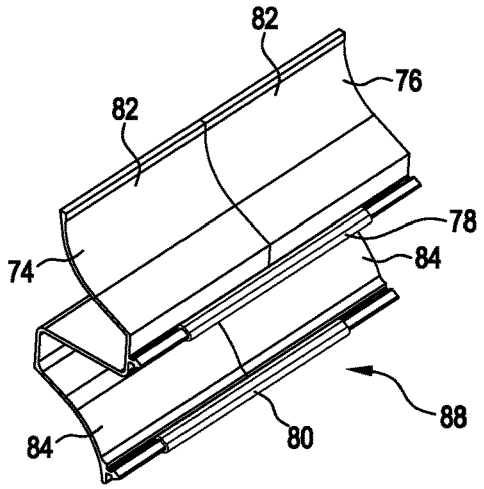
FIG. 20 shows a perspective view of a pair of connectors shown coupling together two lengths of jointing element.

The first length 74 has the same cross-sectional shape as the second length 76. The cross-sectional shape of the element 18 is shown in FIG. 18 across three different sizes of element 18.

The jointing element 18 can be formed as a unitary extrusion.

Figure 15:
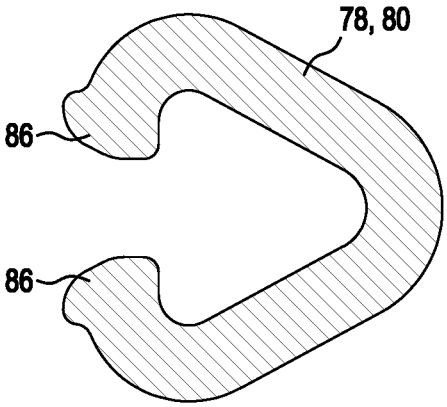
FIG. 15 is a cross-sectional view of a standardised dual joiner connection in accordance with an example embodiment of the present disclosure.
Figure 16:
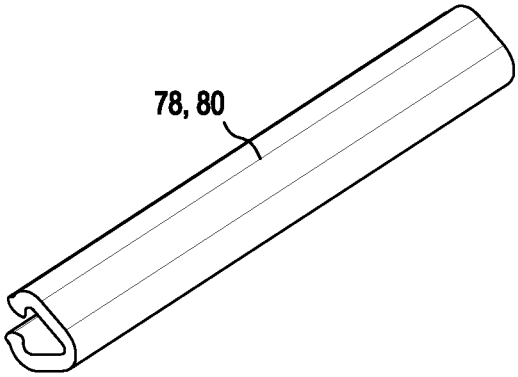
FIG. 16 is a side perspective view of the joiner connection in the form of a connector for coupling together lengths of a jointing element.
Figure 17:
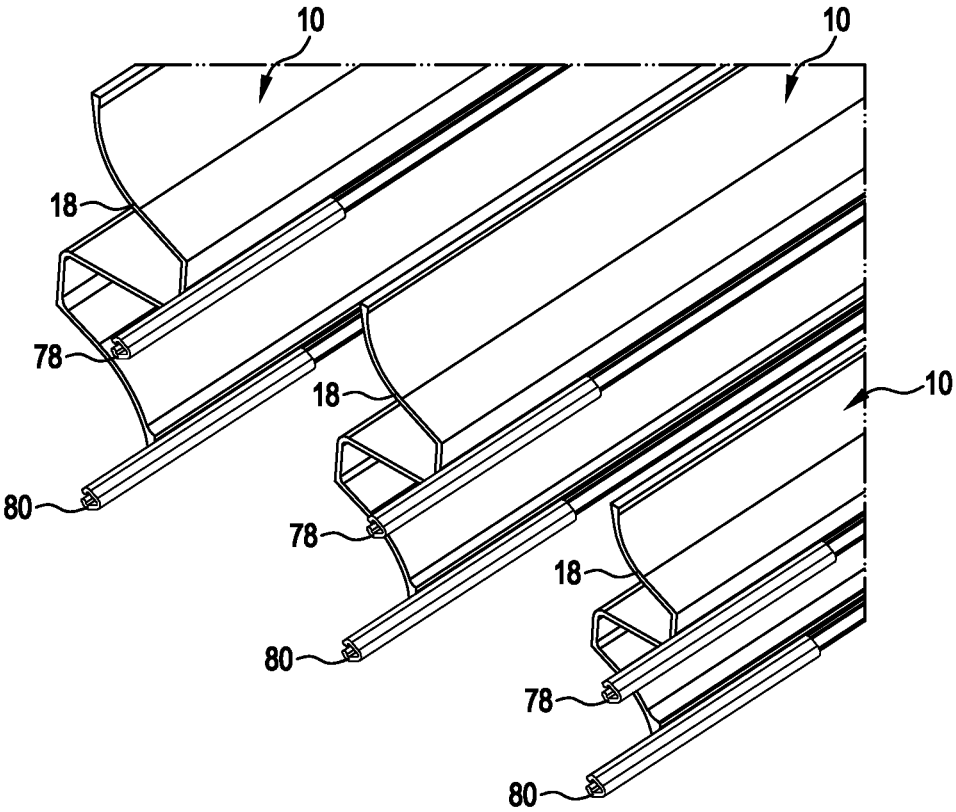
FIG. 17 is side perspective view of three sizes of element of the joint of FIG. 1, each being coupled by a pair of connectors.

The first connector 78 can have the same cross-sectional shape as the second connector 80. The cross-sectional shape of the first connector 78 and second connector 80 is shown in FIG. 15 and a perspective view is shown in FIG. 16.

The first connector 78 and the second connector 80 can each be formed as a unitary extrusion.

As shown in FIG. 18, each of the first length 74 and the second length 76 has an upper formation 46 for coupling the first connector 78 and a lower formation 50 for coupling the second connector 80. The upper formation 46 and the lower formation 50 can each be in the form of barbed formations. The first connector 78 is formed to be resiliently deformable such that it can be selectively slid or clipped onto the upper barbed formations 46. Similarly, the second connector 80 is also formed to be resiliently deformable such that it can be selectively slid or clipped onto the lower barbed formations 50.

The barbed formations 46 and 50 are arranged to also serve to retain the element 18 to one of the concrete panels 16. The barbed formations 46, 50 can also be arranged to serve to couple the element 18 to a stake bracket 48 for supporting the element 18 relative to a ground surface 30.

Each of the first connector 78 and the second connector 80 can be resiliently deformable to facilitate attachment by clipping. Advantageously, the first connector 78 and second connector 80 can be formed of corrosion free plastic material and is able to be cut to a required length, as necessary.

The jointing element 18 can be available in a range of sizes and the same connectors 78, 80 are compatible across the full range of jointing element sizes, as depicted in FIG. 18. This can be achieved by providing the same sized barbed formations 46 and 50 on the full range of jointing element sizes. Also, as shown in FIG. 15, the first connector 78 and second connector 80 is provided with a generally triangular barbed internal shape to complement the shape of the barbed formations 46 and 50. The first connector 78 and second connector 80 cross-section (see FIG. 15) has a pair of free ends 86 which define a gap there between. The gap is narrower than a width of the barbed formations 46 and 50 such that the free ends 86 are required to deform apart resiliently to allow the barbed formations 46 and 50 to be inserted into the connectors 78 and 80 when clipped. The free ends 86 are provided with angled tips to provide tapered approach surfaces for abutment against the tapered barbed formations to facilitate application by clipping.

The jointing element 18 can be formed from a corrosion free plastic material. Advantageously, the jointing element 18 can be cut to a required length, as necessary.

As will be appreciated from the above, there is provided a jointing assembly 88 (see FIG. 20) for formation of a joint 12 in cast concrete, wherein the jointing assembly 88 forms the cast concrete to serve as an expansion joint 12 enabling vertical load transfer across the joint 12. The jointing assembly 88 includes a jointing element 18 having a first length 74 and a second length 76, the assembly further including a first connector 78 and a second connector 80. The first connector 78 is arranged for coupling an upper portion 82 of the first length 74 to an upper portion 82 of the second length 76, and the second connector 80 is arranged for coupling a lower portion 84 of the first length 74 to a lower portion 84 of the second length 76.

The first length 74 and the second length 76 can have a common cross-sectional shape.

The first connector 78 and the second connector 80 can have a common cross-sectional shape. The first length 74 and the second length 76 can each have an upper formation 46 for attaching the first connector 78 and a lower formation 50 for attaching the second connector 80.

Accordingly, as will be appreciated from the above, this aspect can provide an extruded joiner which can provide the following advantages: (1) standardized joiner connection at the top and bottom of the joint profile (two joiners); (2) braces top and bottom of the joint in unison to allow joint profile lengths to be connected in serial; (3) adaptable to different sized joint profiles (100 mm, 125 mm and 150 mm); (4) simple clip on or slide together installation method; (5) clips on the same utility channels as the stake brackets (top and bottom); (6) multi-functional utility channel which allows for components to be attached continuously along the length; (7) panels can be joined with joiner plate at any point when cut; and (8) extruded corrosion free UV stabilised uPVC profile.

Universal Stake Bracket

With reference to FIGS. 21 to 29 of the drawings, another aspect provides an apparatus 10 for forming a pathway joint 12 between concrete panels 14 and 16 to be cast, the apparatus including a jointing element 18 and a stake bracket 48 for supporting the jointing element 18. The jointing element 18 includes an upper formation 46 and a lower formation 50. The stake bracket 48 includes an upper coupling 90 for coupling to said upper formation 46 and a lower coupling 92 for coupling to said lower formation 50. The stake bracket 48 can be used for supporting the jointing element 18 in place relative to the underlying ground surface 30 prior to pouring of the concrete. A single length of the jointing element 18 can be supported by a plurality of stake brackets 48 at spaced intervals (for example, at a maximum spacing of 600 mm, and 100 mm from the ends of the jointing element 18) along the length of the jointing element 18.

In the example shown in the drawings, the stake bracket 48 is arranged to receive a stake 94 for supporting the bracket 48 relative to the ground surface 30. The stake bracket 48 can be height-adjustable relative to the stake 48.

Figure 24:
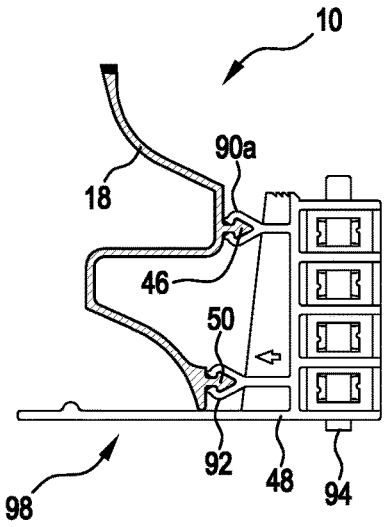
FIG. 24 is a side view of the stake bracket of FIG. 21 supporting a small size of jointing element.
Figure 25:
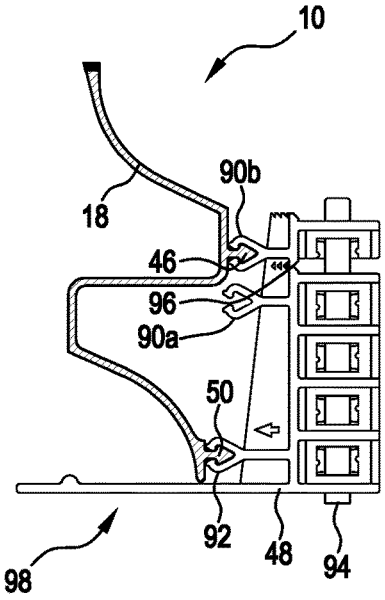
FIG. 25 is a side view of the stake bracket of FIG. 21 supporting a medium size of jointing element.
Figure 26:
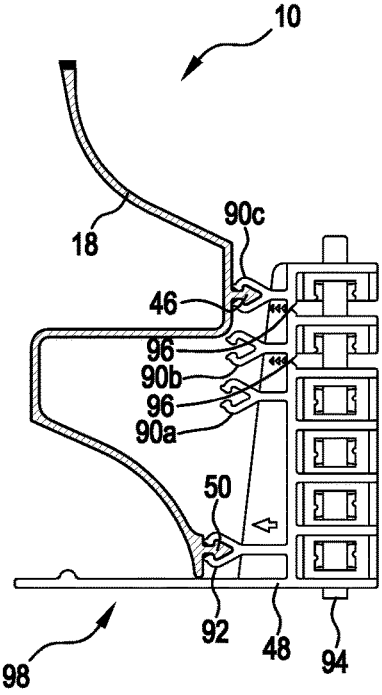
FIG. 26 is a side view of the stake bracket of FIG. 21 supporting a large size of jointing element.
Figure 27:
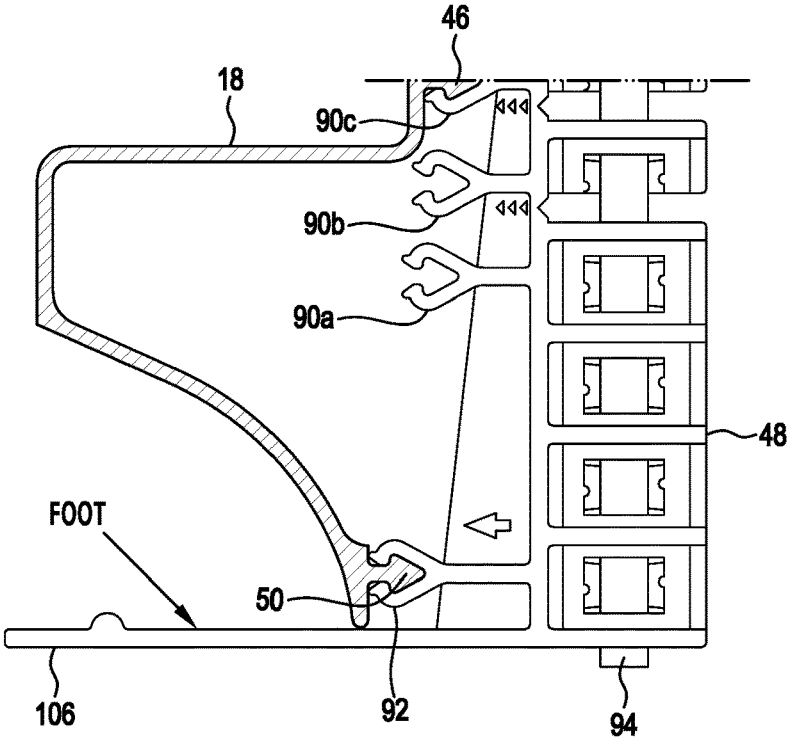
FIG. 27 is a detailed side view of a lower portion of the stake bracket showing a foot of same.
Figure 28:
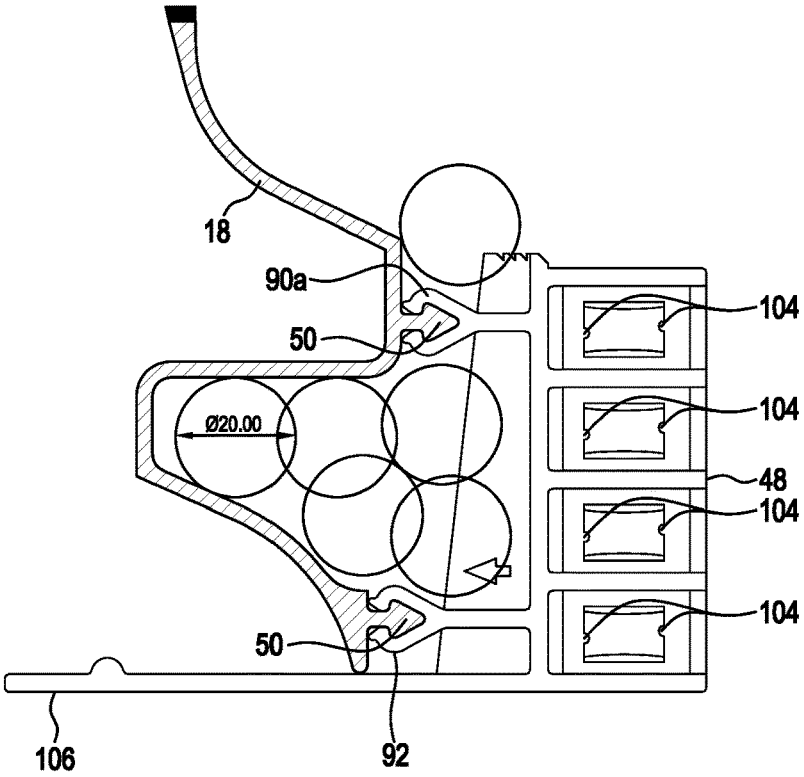
FIG. 28 is a detailed side view of a lower portion of the stake bracket showing flow rate of aggregate between the stake bracket and the jointing element.

More specifically, the stake bracket 48 shown in the drawings is adapted to support a range of sizes of jointing element 18, as depicted in FIGS. 24 to 26. More preferably, the stake bracket 48 has a single lower coupling 92, being common to coupling a lower formation 50 of each size of jointing element, and a plurality of upper couplings 90*a*, 90*b*, and 90*c*. Each of the plurality of upper couplings 90*a*, 90*b*, and 90*c* are at a different spacing relative to the lower coupling 92, each of the upper couplings 90*a*, 90*b*, and 90*c* being for a different size of jointing element. In particular, FIG. 24 shows a small sized element 18 which is compatible with a first upper coupling 90*a*, FIG. 25 shows a medium-sized element 18 that is compatible with a second upper coupling 90*b*, and FIG. 26 shows a large sized element 18 which is compatible with a third upper coupling 90*c*. One or more of the upper couplings 90*a*, 90*b*, and 90*c* can be provided with a frangible connection 96 to enable removal from the stake bracket 48 when not required. Specifically, the stake bracket 48 can be provided with a plurality of upper couplings 90*a*, 90*b*, and 90*c* that are able to be removed by way of the frangible connections 96 when they are not needed.

For example, FIG. 26 shows the stake bracket 48 including all three upper couplings 90*a*, 90*b*, and 90*c* such that outermost upper coupling 90*c* is able to be coupled to the upper formation 46 of the large element 18; FIG. 25 shows the stake bracket 48 including the lower two upper couplings 90*a* and 90*b* such that intermediate upper coupling 90*b* is able to be coupled to the upper formation 46 of the medium element 18; and FIG. 24 shows the stake bracket 48 including only the innermost upper coupling 90*a* such that the innermost upper coupling 90*a* is able to be coupled to the upper formation 46 of the small element 18.

As will be appreciated by those skilled in the art, the example shown in the drawings provides a jointing assembly 98 for formation of a joint 12 in cast concrete, wherein the jointing assembly 98 includes a jointing element 18 and a stake bracket 48 for supporting the jointing element 18. The jointing element 18 is arranged to form the cast concrete to serve as an expansion joint 12 enabling vertical load transfer across the expansion joint 12. The jointing element 18 includes an upper formation 46 and a lower formation 50, and the stake bracket 48 includes an upper coupling 90*a*, 90*b*, and 90*c* for coupling to the upper formation 46 and a lower coupling 92 for coupling to the lower formation 50. The stake bracket 48 can be adapted to support a range of sizes of jointing element 18.

The jointing element 18 can be in the form of a unitary barrier.

The ability of the bracket 48 to support a range of sizes of jointing element 18 can be achieved by way of the stake bracket 48 having a single lower coupling 92, being common to coupling a lower formation 50 of each size of jointing element all 18, and a plurality of upper couplings 90*a*, 90*b*, 90*c*, each of the plurality of upper couplings 90*a*, 90*b*, and 90*c* being at a different spacing relative to the lower coupling 92, each of the upper couplings 90*a*, 90*b*, and 90*c* being for a different size of jointing element 18.

The jointing element 18 and/or the stake bracket 48 has a resiliently deformable portion to enable the stake bracket 48 and the jointing element 18 to be clipped together. In the example shown in the drawings, the upper couplings 90*a*, 90*b*, and 90*c* and the lower coupling 92 are resiliently deformable to facilitate clipping over the arrowhead shaped barbed formations 46 and 50 of the element 18. In an alternative embodiment, the upper formation 46 and the lower formation 50 can be resiliently deformable.

The stake bracket 48 can be formed of corrosion free plastic material.

Figure 21:
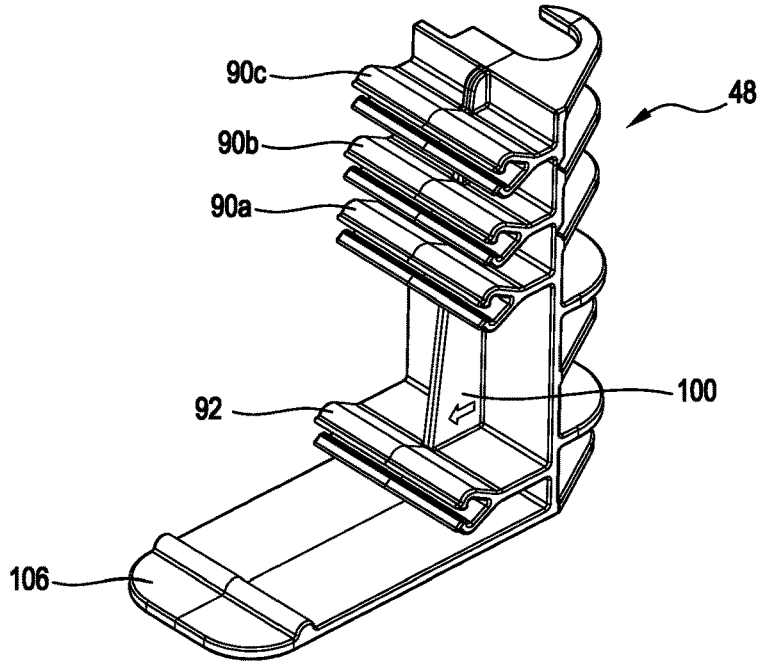
FIG. 21 is a perspective view of a stake bracket for supporting a jointing element in accordance with an example embodiment of the present disclosure.
Figure 22:
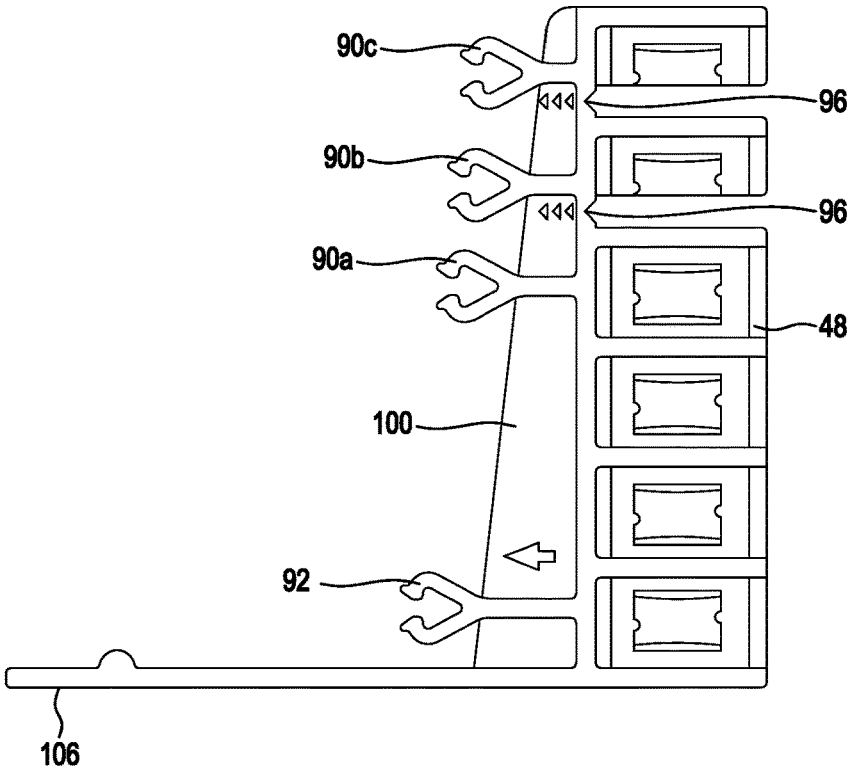
FIG. 22 is a side view of the stake bracket of FIG. 21.
Figure 23:
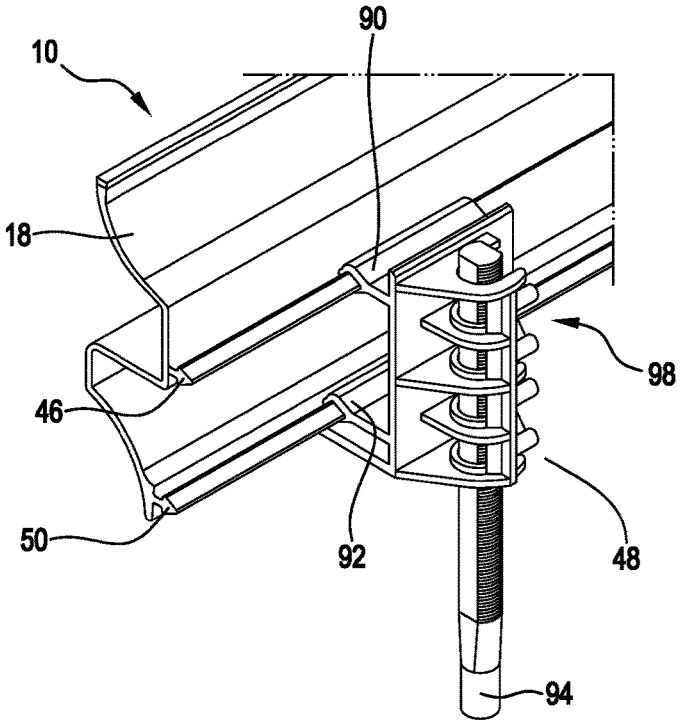
FIG. 23 is a perspective view of the stake bracket of FIG. 21 shown supporting an element relative to a stake.

As shown clearly in FIG. 21 and FIG. 22, the stake bracket 48 can have a central rib 100. The central rib 100 extends between the upper couplings 90*a*, 90*b*, 90*c* and the lower coupling 92. The central rib 100 has a pair of frangible connections 96 to enable removal of one or more of the upper couplings 90*b* and 90*c* from the stake bracket 48 when not required. The stake bracket 48 can be marked with a corresponding sizing of a jointing element 18 for one or more of the upper couplings 90*a*, 90*b*, and 90*c*. For example, in FIG. 22 the intermediate upper coupling 90*b* is marked on the central rib 100 as being suitable for a jointing element 18 of 125 mm size and the outermost upper coupling 90*c* is marked on the central rib 100 as being suitable for a jointing element 18 of 150 mm size.

Figure 29:
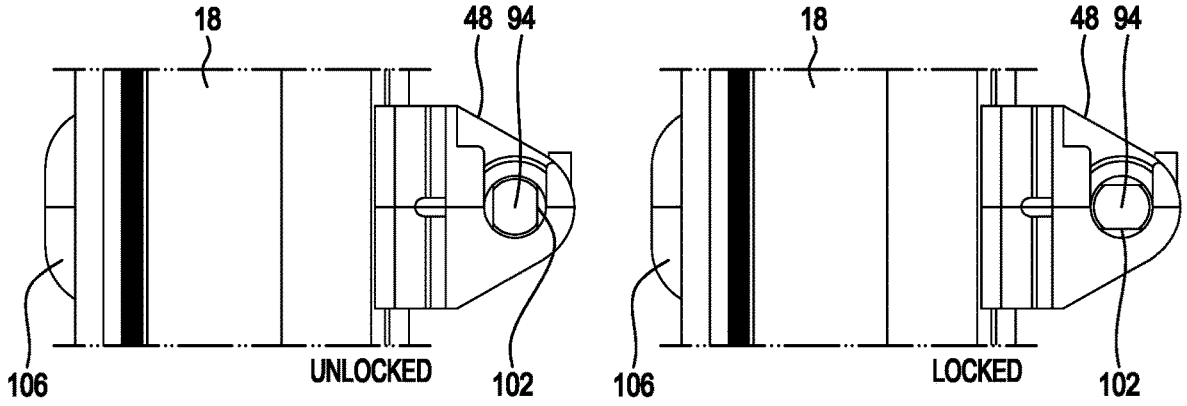
FIG. 29 shows two top views of the stake bracket, depicting a twist and lock arrangement relative to the stake, in an unlocked condition and in a locked condition.

As shown in FIG. 29, the stake bracket 48 can have a receiving cavity 102 adapted to enable twist-and-lock height adjustment of the stake bracket 48 relative to the stake 94. In FIG. 29, there is shown a left-hand depiction of the stake 94 in an unlocked condition and a right-hand depiction of the stake 94 in a locked condition. In the example shown, the stake 94 has a cross-section with a large threaded dimension and a small threaded dimension (provided by opposed parallel flattened sides) such that the stake 94 can be rotated 90° between the unlocked condition and the locked condition. This functionality is also enabled by virtue of the opposed threads 104 (see FIG. 28) which serve to lock the stake 94 from vertical movement relative to the stake bracket 48 when the opposed threads of the stake 94 (see FIG. 27) are rotated to engage with the opposed threads 104 of the stake bracket 48.

The stake bracket 48 can include a foot extension 106 to enable freestanding of the jointing assembly 98 on the ground surface 30. Also, the foot extension 106 can assist in stabilising the stake bracket 48 on the ground surface 30 during driving of the stake 94 into the ground surface 30. Bar chairs and mesh can be used between jointing elements 18.

As will be appreciated from the above, examples of this aspect can provide a clip-on injection moulded stake bracket having one or more of the following advantages: (1) formwork bracing and height adjustment system; (2) attached to any point of the formwork panel with simple click on usability; (3) standardised stake bracket is suitable for use on multiple formwork panel heights (100 mm, 125 mm and 150 mm) by way of snap off top clipping sections. Designed for the largest panel height, two clip-on sections at the top of the bracket can be removed onsite quickly and easily to allow the bracket to suit smaller heights while maintaining concrete cover; (4) common shared connection point at the base; (5) perforation points to facilitate snap off function; (6) corrosion free, UV stabilised construction; (7) fastener-less attachment process is quick and intuitive; (8) central rib-based shape provides additional anchorage of the joint in one slab (pour through); (9) shape facilitates concrete flow around the joint profile; (10) twist and lock stake lock off for height and level adjustment onsite; and (11) foot extension at base to enable freestanding of the joint profile.

Examples of the present disclosure can thus alleviate uneven pathways resulting from movement caused by tree roots and/or reactive soil on pathway joints. Various current joints (formed control joints and expansion joints) do not allow for any or sufficient articulation. They provide some load transfer and allow slabs to separate to prevent cracking. Neighbouring slabs at joints can deflect against each other leaving steps in the concrete. Tree root heave causes slabs to deflect at joints normally requiring repair. Repairing joints means having to grind back the step in the concrete flush-if this cannot be done then the slab needs to be removed and replaced. Both these methods are costly and time extensive for councils. This need to be done for steps greater than 5 mm. As the tree root gets bigger, the step can occur again requiring more maintenance to occur. In the case of reactive soils, the deflection can occur cyclically with the changes in ground moisture which can be affected by season. This makes it difficult to repair slabs. Reactive movement can also occur between day and night. The main function of the articulating joint is to eliminate the issues with both tree root heave and reactive soils, by providing a joint that allows the neighbouring slabs to lift together minimising the deflection below the allowable 5 mm. These ramping slabs provide smooth transition for wheeled devices. This minimizes joint and concrete repair and replacement. As they act like hinges in the concrete, they can rise and fall with reactive soils to maintain the smooth transition during ground moisture changes. As well as an articulating joint they still need to function as a control joint, providing load transfer between neighbouring slabs. They can be used for all formed control joints or just be placed in problem areas. For example, at the joints on footpaths beside a location where a tree is planted or located.

While various embodiments of the present disclosure have been described above, it should be understood that they have been presented by way of example only, and not by way of limitation. It will be apparent to a person skilled in the relevant art that various changes in form and detail can be made therein without departing from the spirit and scope of the disclosure. Thus, the present disclosure should not be limited by any of the above-described exemplary embodiments.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

LIST OF NUMBERED FEATURES

Apparatus 10
Joint 12
Second concrete panel 14
First concrete panel 16
Element 18
Barrier 20
Upper section 22
Upper round surface 24
Lower section 26
Lower round surface 28
Underlying ground surface 30
Upper convex rounding 32
Lower concave rounding 34
Upper concave rounding 36
Lower convex rounding 38
Transverse section 40
Upper transverse surface 42
Lower transverse surface 44
Upper formation 46
Stake bracket 48
Lower formation 50
Capping 52
Recess 54
Frangible connecting strips 56
Upper hinge 58
Lower hinge 60
Upper shear key 62
Lower shear key 64
Upper shear key 66
Lower shear key 68

Planar surface (lower) 70
Planar surface (upper) 72
First length of element 74
Second length of element 76
First connector 78
Second connector 80
Upper portion 82
Lower portion 84
Free ends 86
Jointing assembly 88
Upper coupling 90
Lower coupling 92
Stake 94
Frangible connection 96
Jointing assembly 98
Central rib 100
Receiving cavity 102
Opposed threads 104
Foot extension 106

What is claimed is:

1. An apparatus for forming a joint between first and second concrete panels to be cast, the apparatus comprising:
an element in the form of a unitary extrusion and having:
an upper section including an upper round surface enabling relative rotation of the first and second concrete panels in a first direction, and
a lower section including a lower round surface enabling relative rotation of the first and second concrete panels in a second direction opposite to the first direction.

2. The apparatus of claim 1, wherein said upper section is shaped to form a first rounding in the first concrete panel and a corresponding second rounding in the second concrete panel for relative rotation of the first and second concrete panels in the first direction.

3. The apparatus of claim 2, wherein said lower section is shaped to form a third rounding in the first concrete panel and a corresponding fourth rounding in the second concrete panel for relative rotation of the first and second panels in the second direction.

4. The apparatus of claim 1, wherein the element includes a transverse section connecting the upper section and the lower section, the transverse section configured to form an upper transverse surface in the first concrete panel and a corresponding lower transverse surface in the second concrete panels to enable transferring vertical force across the joint.

5. The apparatus of claim 4, wherein the transverse section is planar.

6. The apparatus of claim 4, wherein the transverse section is horizontal.

7. The apparatus of claim 4, wherein the transverse section is intermediate the upper section and the lower section.

8. The apparatus of claim 1, wherein the upper section is configured to form an upper rounding in the first concrete panel and a corresponding lower rounding in the second concrete panel, and the lower section is configured to form an upper rounding in the first concrete panel and a corresponding lower rounding in the second concrete panel.

9. The apparatus of claim 1, wherein the upper section is configured to form an upper convex rounding in the first concrete panel and a corresponding lower concave rounding in the second concrete panel, and the lower section is configured to form an upper concave rounding in the first concrete panel and a corresponding lower convex rounding in the second concrete panel.

10. The apparatus of claim 1, wherein the element includes an upper formation couplable to a stake bracket and a lower formation couplable to the stake bracket.

11. The apparatus of claim 10, wherein the element includes a transverse section connecting the upper section and the lower section, wherein the upper formation is located above the transverse section and the lower formation is located below the transverse section.

12. An apparatus for forming a joint between first and second concrete panels to be cast, the apparatus comprising:
an element in the form of a unitary extrusion and having:
an upper section,
a lower section; and
a transverse section connecting the upper section and the lower section,
wherein the element is configured to form the joint to serve as an expansion joint enabling vertical load transfer between the first and second concrete panels across the joint, and
wherein the element is configured to form the joint to act as a hinge enabling articulation across the joint.

13. The apparatus of claim 12, wherein the element is configured to form an upper hinge that enables rotation of the first concrete panel in one direction relative to the second concrete panel, and is configured to form a lower hinge that enables rotation of the first concrete panel in an opposite direction relative to the second concrete panel.

14. The apparatus of claim 13, wherein the upper section is configured to form the upper hinge and the lower section is configured to form the lower hinge.

15. The apparatus of claim 14, wherein the transverse section is intermediate the upper section and the lower section.

16. The apparatus of claim 15, wherein the transverse section is planar.

17. The apparatus of claim 16, wherein the transverse section is horizontal.

18. The apparatus of claim 12, which comprises a removable capping at an upper portion of the element.

19. An apparatus for forming a joint between first and second concrete panels to be cast, the apparatus comprising:
an element having:
an upper section including an upper round surface enabling relative rotation of the first and second concrete panels in a first direction, said upper section shaped to form a first rounding in the first concrete panel and a corresponding second rounding in the second concrete panel for relative rotation of the first and second concrete panels in the first direction, and
a lower section including a lower round surface enabling relative rotation of the first and second concrete panels in a second direction opposite to the first direction.

20. An apparatus for forming a joint between first and second concrete panels to be cast, the apparatus comprising:
an element having:
an upper section including an upper round surface enabling relative rotation of the first and second concrete panels in a first direction, and
a lower section including a lower round surface enabling relative rotation of the first and second concrete panels in a second direction opposite to the first direction,
a transverse section connecting the upper section and the lower section, the transverse section configured to form an upper transverse surface in the first concrete panel and a corresponding lower transverse surface in the second concrete panels to enable transferring vertical force across the joint.

21. An apparatus for forming a joint between first and second concrete panels to be cast, the apparatus comprising:

an element having:

an upper section including an upper round surface enabling relative rotation of the first and second concrete panels in a first direction, the upper section configured to form an upper rounding in the first concrete panel and a corresponding lower rounding in the second concrete panel, and a lower section including a lower round surface enabling relative rotation of the first and second concrete panels in a second direction opposite to the first direction, the lower section configured to form an upper rounding in the first concrete panel and a corresponding lower rounding in the second concrete panel.

22. An apparatus for forming a joint between first and second concrete panels to be cast, the apparatus comprising:

an element having:

an upper section including an upper round surface enabling relative rotation of the first and second concrete panels in a first direction, the upper section configured to form an upper convex rounding in the first concrete panel and a corresponding lower concave rounding in the second concrete panel, and a lower section including a lower round surface enabling relative rotation of the first and second concrete panels in a second direction opposite to the first direction, the lower section configured to form an upper concave rounding in the first concrete panel and a corresponding lower convex rounding in the second concrete panel.

23. An apparatus for forming a joint between first and second concrete panels to be cast, the apparatus comprising:

an element having:

an upper section including an upper round surface enabling relative rotation of the first and second concrete panels in a first direction, and a lower section including a lower round surface enabling relative rotation of the first and second concrete panels in a second direction opposite to the first direction, an upper formation couplable to a stake bracket, a lower formation couplable to the stake bracket, a transverse section connecting the upper section and the lower section, wherein the upper formation is located above the transverse section and the lower formation is located below the transverse section.

24. An apparatus for forming a joint between first and second concrete panels to be cast, the apparatus comprising:

an element having:

an upper section, a lower section; and a transverse section connecting the upper section and the lower section, wherein the element is configured to form the joint to serve as an expansion joint enabling vertical load transfer between the first and second concrete panels across the joint, wherein the element is configured to form the joint to act as a hinge enabling articulation across the joint, and wherein the element is configured to form an upper hinge that enables rotation of the first concrete panel in one direction relative to the second concrete panel, and is configured to form a lower hinge that enables rotation of the first concrete panel in an opposite direction relative to the second concrete panel.

* * * * *